US011346579B2

(12) United States Patent
Morales et al.

(10) Patent No.: US 11,346,579 B2
(45) Date of Patent: May 31, 2022

(54) VENTED COVER PLATE

(71) Applicant: Kärcher North America, Inc., Denver, CO (US)

(72) Inventors: Guillermo Morales, Monterrey (MX); Trent Garner, Highlands Ranch, CO (US); Glenn Schmierer, Denver, CO (US)

(73) Assignee: KARCHER NORTH AMERICA, INC., Denver, CO (US)

( * ) Notice: Subject to any disclaimer, the term of this patent is extended or adjusted under 35 U.S.C. 154(b) by 0 days.

(21) Appl. No.: 16/856,872

(22) Filed: Apr. 23, 2020

(65) Prior Publication Data

US 2020/0340710 A1 Oct. 29, 2020

Related U.S. Application Data

(60) Provisional application No. 62/838,112, filed on Apr. 24, 2019.

(51) Int. Cl.

| | |
|---|---|
| ***F24H 9/02*** | (2006.01) |
| ***F24H 1/00*** | (2022.01) |
| ***F24H 1/06*** | (2022.01) |
| ***F24H 1/16*** | (2022.01) |
| ***B08B 3/02*** | (2006.01) |

(52) U.S. Cl.

CPC ..... *F24H 9/02* (2013.01); *B08B 3/02* (2013.01); *F24H 1/0072* (2013.01); *F24H 1/06* (2013.01); *F24H 1/165* (2013.01); *B08B 2203/007* (2013.01); *B08B 2203/0211* (2013.01)

(58) Field of Classification Search

CPC ..... B08B 2203/007; B08B 2203/0211; B08B 3/026; B08B 3/02; F24H 9/02; F24H 1/165; F24H 1/06; F24H 1/0072; F24F 13/082

See application file for complete search history.

(56) References Cited

U.S. PATENT DOCUMENTS

| | | | |
|---|---|---|---|
| 2,158,735 | A | 5/1939 | Vigneauit |
| 3,359,949 | A | 12/1967 | Bjarnason et al. |
| 3,841,273 | A | 10/1974 | Finger et al. |
| D251,007 | S | 2/1979 | Burgoon |
| 4,357,910 | A | 11/1982 | Blockley et al. |
| 4,432,472 | A | 2/1984 | Lamm |
| D273,431 | S | 4/1984 | Linton |

(Continued)

FOREIGN PATENT DOCUMENTS

| | | |
|---|---|---|
| AU | 2003268175 | 3/2004 |
| CA | 2919491 | 7/2016 |

(Continued)

OTHER PUBLICATIONS

U.S. Appl. No. 29/672,435, filed Dec. 5, 2018, Garner et al.

(Continued)

*Primary Examiner* — Steven S Anderson II

(74) *Attorney, Agent, or Firm* — Sheridan Ross P.C.

(57) ABSTRACT

The present disclosure relates generally to protective devices and cover members. In some embodiments, cover members are provided that are operable to protect covered components and to allow heat dissipation from the components. Cover members of the present disclosure are suitable for use with heat exchangers including, for example, those provided with hot water pressure washers.

20 Claims, 10 Drawing Sheets

(56) References Cited

U.S. PATENT DOCUMENTS

| | | | | |
|---|---|---|---|---|
| 4,524,477 | A | 6/1985 | Williams, III et al. | |
| D282,110 | S | 1/1986 | Tucker et al. | |
| 4,697,464 | A | 10/1987 | Martin | |
| D296,250 | S | 6/1988 | Genovese | |
| D296,251 | S | 6/1988 | Genovese | |
| 4,902,139 | A | 2/1990 | Adiutori | |
| D314,648 | S | 2/1991 | Linton | |
| D317,668 | S | 6/1991 | Bolser et al. | |
| D321,420 | S | 11/1991 | Von Vett et al. | |
| D344,163 | S | 2/1994 | Joines | |
| 5,551,331 | A | 9/1996 | Pfeifer et al. | |
| D375,590 | S | 11/1996 | Steinhart et al. | |
| 5,713,310 | A | 2/1998 | Lemke | |
| 5,954,494 | A | 9/1999 | Goldsmith et al. | |
| 6,085,739 | A | 7/2000 | Leiss | |
| D446,612 | S | 8/2001 | Kohler | |
| D496,763 | S | 9/2004 | Chen | |
| D523,193 | S | 6/2006 | Hong | |
| D556,959 | S | 12/2007 | Li | |
| D612,040 | S * | 3/2010 | Daniels | D23/373 |
| D633,263 | S | 2/2011 | Fay | |
| D659,310 | S | 5/2012 | Dammkoehler | |
| 9,004,017 | B2 * | 4/2015 | Narita | F24D 19/0092 122/14.3 |
| D739,100 | S | 9/2015 | Tatic et al. | |
| D756,576 | S | 5/2016 | Wang | |
| D778,011 | S | 1/2017 | Alexander et al. | |
| 9,724,734 | B2 | 8/2017 | Linton et al. | |
| 9,841,244 | B2 | 12/2017 | Boehm et al. | |
| D824,612 | S | 7/2018 | Alexander | |
| D824,613 | S | 7/2018 | Alexander et al. | |
| 2008/0128032 | A1 * | 6/2008 | Lapetina | B08B 3/026 137/334 |
| 2014/0048140 | A1 | 2/2014 | Rohner et al. | |
| 2015/0245758 | A1 | 9/2015 | Wall et al. | |

FOREIGN PATENT DOCUMENTS

| | | |
|---|---|---|
| CN | 2669751 | 1/2005 |
| CN | 202010668 | 10/2011 |
| CN | 102580939 | 7/2012 |
| CN | 202636614 | 1/2013 |
| CN | 202806701 | 3/2013 |
| CN | 103624021 | 3/2014 |
| CN | 204018271 | 12/2014 |
| CN | 204107899 | 1/2015 |
| EP | 0497113 | 8/1992 |
| JP | 2012-217978 | 11/2012 |
| JP | 2017-070911 | 4/2017 |
| KR | 300458182.0000 | 8/2007 |
| WO | WO 2005/107559 | 11/2005 |
| WO | WO 2012/040997 | 4/2012 |

OTHER PUBLICATIONS

"Hot Series 11090930," Landa Karcher Group, date unknown, retrieved from https://www.landa.com/en/products/hot-water-pressure-washers/electric-powered-hot-waler-pressure-washers/hot-series-11090930.html.

Official Action for Canadian Patent Application No. 185725, dated Feb. 11, 2020, 3 pages.

Official Action for U.S. Appl. No. 29/672,435, dated Dec. 9, 2019, 6 pages. Restriction Requirement.

Official Action for U.S. Appl. No. 29/672,435, dated Mar. 3, 2020, 7 pages.

Official Action for U.S. Appl. No. 29/672,435, dated Aug. 12, 2020, 5 pages.

Notice of Allowance for U.S. Appl. No. 29/672,435, dated Dec. 3, 2020, 8 pages.

Corrected Notice of Allowance for U.S. Appl. No. 29/672,435, dated Dec. 28, 2020, 3 pages.

Official Action for Canadian Patent Application No. 3079554, dated Aug. 19, 2021, 6 pages.

* cited by examiner

VENTED COVER PLATE

This U.S. Non-Provisional Patent Application claims the benefit of priority from U.S. Provisional Patent Application Ser. No. 62/838,112, filed Apr. 24, 2019, the entire disclosure of which is hereby incorporated by reference.

FIELD

The present disclosure relates generally to vented cover members for heat exchangers and similar devices. More specifically, various embodiments of the present disclosure provide a vented cover member for provision with hot water pressure washers to protect various components of pressure washers, regulate the temperature of various components, and enhance the overall safety of a device. Although various embodiments shown and described herein relate to pressure washing devices, the present disclosure and vented cover members provided herewith are not limited to pressure washers or any particular application.

BACKGROUND

Various portable pressure washing devices are known. Many portable pressure washing devices comprise a gas-engine or an electric motor for driving a pump. Some of these devices include the ability to deliver or dispense heated fluid, whereas others simply pressurize a flow of fluid without warming or heating. Pressure washing devices that comprise the ability to heat a fluid typically comprise structures and features such as burners and heat exchangers.

Portable hot water pressure washers are known that comprise a fluid conduit (e.g. a coil), a pump, and other components that are covered by a body or casing for safety, functionality, and aesthetic purposes. Such devices are also provided with at least some exposed components to allow for heat management and ease of service, for example. One such device is shown and described in United States Publication No. 2014/0048140 to Rohner et al., which is hereby incorporated by reference in its entirety. Hot water pressure washing devices comprise coils, fuel lines, igniters and associated electronics and components requiring protection from external elements and forces, and from which users and bystanders should be protected. Known protective devices include plates and spun metal covers with a vent or stack extending therefrom to allow for ventilation of heat and gas resulting from a combustion process, for example. However, such devices suffer from various limitations. For example, devices comprising these plates or covers typically fail to provide both an acceptable level of safety and an appropriate level of heat dissipation or management. Additionally, these devices are also difficult and expensive to manufacture.

SUMMARY

Accordingly, there has been a long-felt and unmet need to provide cooling and safety features for a heat exchanger or heating coil including, but not limited to those provided with hot water pressure washers.

In various embodiments, systems and devices are provided to enhance the cooling and ventilation of a hot water pressure washer. In certain embodiments, a cover member is provided that comprises a plurality of voids, apertures and/or or slots to vent heat and gas from a burner (for example), and to maintain device components (e.g. an igniter and electronic control) at a proper temperature. Cover members of the present disclosure further comprise safety features to prevent users and objects from coming into contact with dangerously hot components of the device, and to protect the components from impact and damage from moving water lines, hoses, and other objects.

In some embodiments, cover members are provided that are relatively easy and cost-effective to manufacture at least as compared with known devices. In certain embodiments, cover members are provided that provide visibility into covered components such that a user can view internal components of a device, but physical access to the internal components is substantially prevented.

In certain embodiments, cover members are provided that allow for ventilation of gas and heat and which provide a protective barrier for one or more fuel lines. The protective barrier comprises a barrier that prevents contact between fuel lines and external components, such as hoses (for example). Devices of the present disclosure eliminate or reduce the risk of damage to fuel lines, and the various dangers associated with the same.

Various embodiments of the present disclosure provide cover and venting features. In some embodiments, cover and venting members are provided for a heating or exhaust portion of a hot water pressure washer. In one embodiment, a hot water pressure washer is provided that comprises a chassis, front wheels, rear wheels, driving or pressurizing equipment, heating elements, and a user interface or steering mechanism. The pressurizing equipment is contemplated as comprising a motor and a pump. The heating elements are contemplated as comprising a housing, a fuel tank, a burner, a coil heat exchanger, an exhaust, a user interface, and related electronics and controls. In various embodiments, a cover member is provided in combination with the heating elements to protect internal components thereof and to allow for ventilation of heat and gas from an internal volume or area of the heating elements. In certain embodiments, the cover member comprises metal cover operable to be provided on and extend over at least a portion of a housing or shroud of the heating element. Cover members of the present disclosure preferably comprise a plurality of apertures as shown and described herein. The apertures are operable to allow for the escape and ventilation of heat and gas from internal components of associated devices to an external environment. Cover members of the present disclosure are further operable to provide visibility into internal components, and to prevent unwanted ingress of various objects (hoses, fingers, debris, etc.) into the heating elements.

In some embodiments, cover members of the present disclosure are formed from a single sheet of metal. For example, in some embodiments, a single sheet of material is bent and cut to form a convex or upstanding cover. The material is contemplated as comprising steel, aluminum, and various other metals as will be recognized by one of ordinary skill in the art. Certain embodiments comprise at least one tab or connecting member to selectively secure the cover to an associated device. The tab or connecting member is contemplated as comprising at least one aperture through which a fastener can be provided to secure the cover to another component. In various embodiments, cover members of the present disclosure comprise a generally convex shape that is devoid of sharp angles, edges, or lips upon which various devices (e.g. hoses) can get caught. In some embodiments, cover members of the present disclosure comprise a plurality of angled, downward sloping sidewalls and a substantially planar primary member. The device thus comprises a generally convex cover with the primary member being positioned vertically higher than other components of the device. In alternative embodiments, cover members of the present disclosure comprise a rounded or domed member. In further embodiments, cover members of the present disclosure comprise a frustoconical member with a flat or planar upper surface, and wherein apertures are provided in at least the upper member.

In various embodiments of the present disclosure, cover members comprise a plurality of apertures to allow for a ventilation and egress of heat and gas and further comprise an aperture or void to accommodate an exhaust member, such as a chimney or exhaust stack of a device on which the cover member is to be provided. For example, in embodiments that contemplate provision with or communication with a heating element of a hot water pressure washer, cover members comprise an aperture or void that is sized and operable to allow an exhaust member of a burner to extend through the cover member. In such embodiments, the void and the associated exhaust member provide a means for properly aligning and installing the cover member, in addition to allowing the exhaust member to perform its intended functions.

In some embodiments, cover members are provided with an array or plurality of apertures. The apertures are positioned a predetermined distance from the top surface of the heating system, and the plurality of cooling apertures covers between about 20% and 70% of a surface area of the cover member. In various embodiments, each of the apertures comprises an open area of not more than about four-square inches. In some embodiments, each of the apertures comprises an aperture with an open area of approximately 0.25 square inches.

In one embodiment, a vented cover member operable for use with a heat exchanger is provided. The vented cover member comprises a planar member with a plurality of first apertures distributed over a surface area of the planar member. A plurality of sidewalls is provided, and the sidewalls are angled relative to the planar member and the sidewalls extend downwardly from the planar member. At least one of the plurality of sidewalls comprises an aperture operable to receive a fastener to selectively secure the vented cover member to a preexisting device. At least one of the plurality of sidewalls comprises an exhaust aperture, and the exhaust aperture is larger than each of the first apertures and is operable to receive at least one of pipe, a stack and a conduit.

In one embodiment, a heat exchanger for use with hot water pressure washer is provided that comprises a heating element having a housing, a coil, a burner, an igniter and a control unit. An exhaust member in the form of a pipe is provided that directs an exhaust gas away from the burner and into an ambient environment. A cover member is provided that comprises a first planar portion with a plurality of apertures, the first planar portion being operable to prevent impact and contact with at least the igniter (and associated controls), and the apertures being operable to dissipate heat from the igniter and associated components. The cover member further comprises a plurality of sidewalls extending from the first planar portion. At least one of the plurality of sidewalls comprises an exhaust aperture, wherein the exhaust pipe extends through the exhaust aperture.

In various embodiments, methods of forming a cover member are provided. In some embodiments, methods of the present disclosure comprise providing a metal material, forming a plurality of apertures in the material, forming a plurality of cuts, slots, or perforations in the material, and providing at least one bend in the material wherein the bend comprises a transition between a first planar portion and an angled sidewall of the cover member.

In some embodiments, a wireframe or cage member is provided. Although preferred embodiments comprise a perforated cover plate formed from sheet metal (for example) with apertures of voids provided therein, it is also contemplated that cover members of the present disclosure comprise a wireframe member. Wireframe members of the present disclosure are contemplated as comprising a flat surface with a plurality of angled sidewalls (e.g. 90 degree sidewalls), as well as domed wireframe members and other shapes.

In various embodiments of the present disclosure, heat exchanger devices are provided that comprise a burner that is operable to heat a fluid moving through the heat exchanger (e.g. through a coil or arrangement of tubing). In some embodiments, the burner is activated or controlled by at least one electronic igniter provided proximal to an exhaust area for heat and gas from the burner. In preferred embodiments, at least one of an igniter and an igniter control unit is provided vertically above a burner. In such embodiments, thermal management features are provided to maintain the igniter and control unit(s) at desired or acceptable temperatures. Heat exchanger devices comprising at least one electronic igniter disposed vertically above a coil or proximal to an upper portion of a burner and coil include, for example, devices shown and described in U.S. Pat. No. 9,841,244 to Boehm et al., which is hereby incorporated by reference in its entirety. The arrangement of components of the devices shown and described in Boehm (for example) can result in elevated temperatures of an igniter and related electronics. Embodiments of the present disclosure provide for a vented cover member that is operable to manage and mitigate heating effects of such devices while also providing a protective physical barrier and other benefits and protection for internal components of the device(s).

In some embodiments of the present disclosure, vented cover members are provided in combination with a heat exchanger that is operable to heat fluid (e.g. water) passing through a coil to a temperature of at least approximately 90 degrees Celsius, and wherein the temperatures of a stack arrangement including a coil, a burner and an igniter reaches at least about 230 degrees Celsius. The arrangement and ventilation features of the cover plate are operable to vent heat from the cover plate itself, and the cover plate has been found to not exceed temperatures of 65 degrees Celsius. In one embodiment, Applicant has determined that a heat exchanger with a cover plate in accordance with embodiments of the present disclosure can be operated with a fluid/water flow rate of about 2.18 gallons per minute and wherein a volume of fluid entering the system comprises an inlet temperature of about 18 degrees Celsius and an outlet temperature of about 96.9 degrees Celsius. During operation with an ambient temperature of about 30.5 degrees Celsius, a temperature of a stack of the device, including a coil, reaches a maximum of about 235 degrees Celsius and the temperature of the vented cover plate reaches a maximum of about 61.5 degrees Celsius.

Although various embodiments shown and described herein relate to and contemplate devices with burners and coils provided in a substantially vertical or upright arrangement, the present disclosure is not limited to such devices. It is contemplated, for example, that various features of the present disclosure including but not limited to cover members are useful with and provided with alternative arrangement including, for example, devices with burners and coils that are provided in a substantially horizontal arrangement.

It will be recognized that inventive aspects of the present disclosure are not limited to a particular device, or a particular arrangement of a device.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

DETAILED DESCRIPTION

Embodiments of the present disclosure have significant benefits across a broad spectrum of endeavors. It is the Applicant's intent that this specification be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Figure 1:
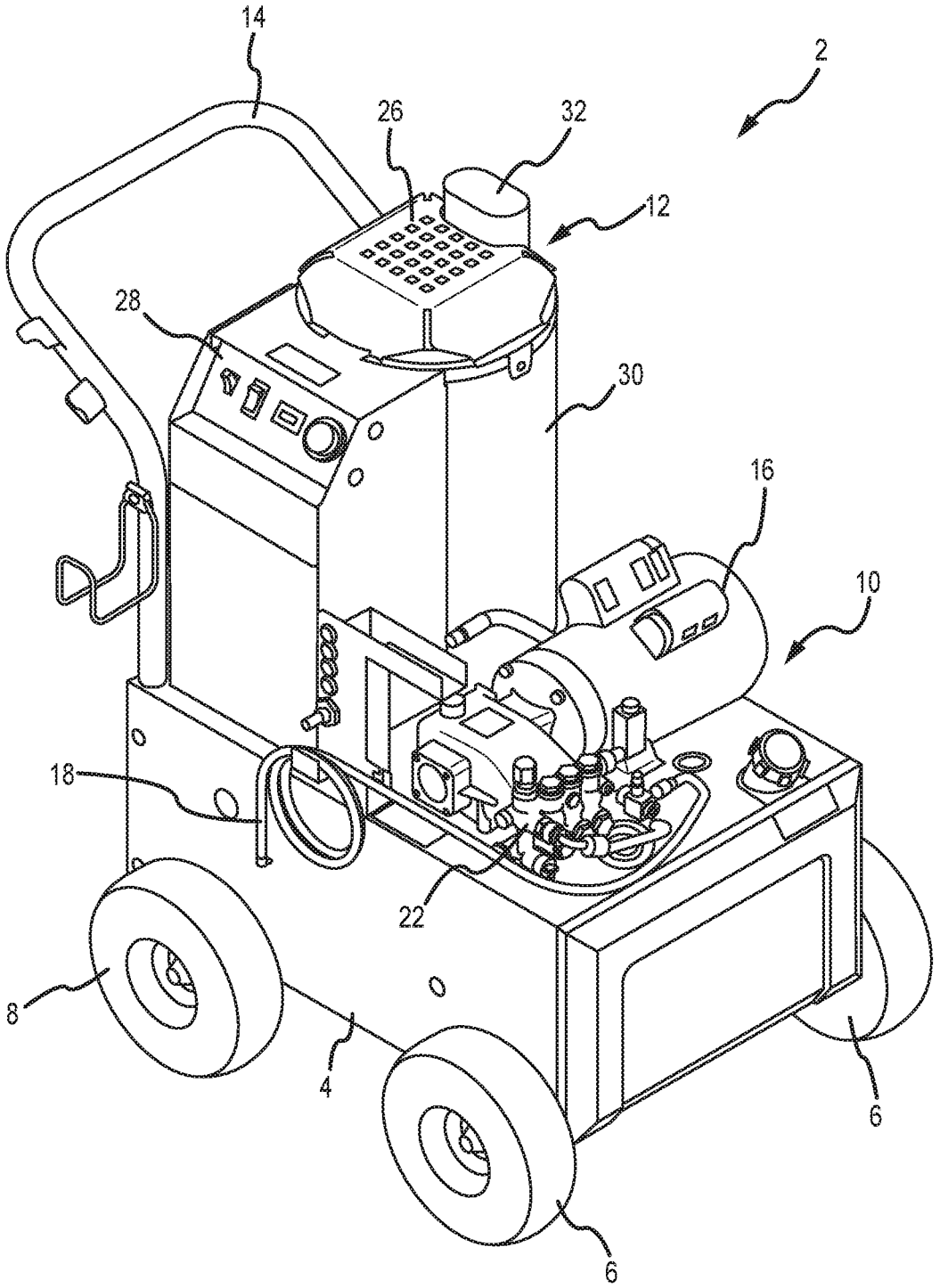
FIG. 1 is a perspective view of a pressure washing device according to one embodiment of the present disclosure.
Figure 2:
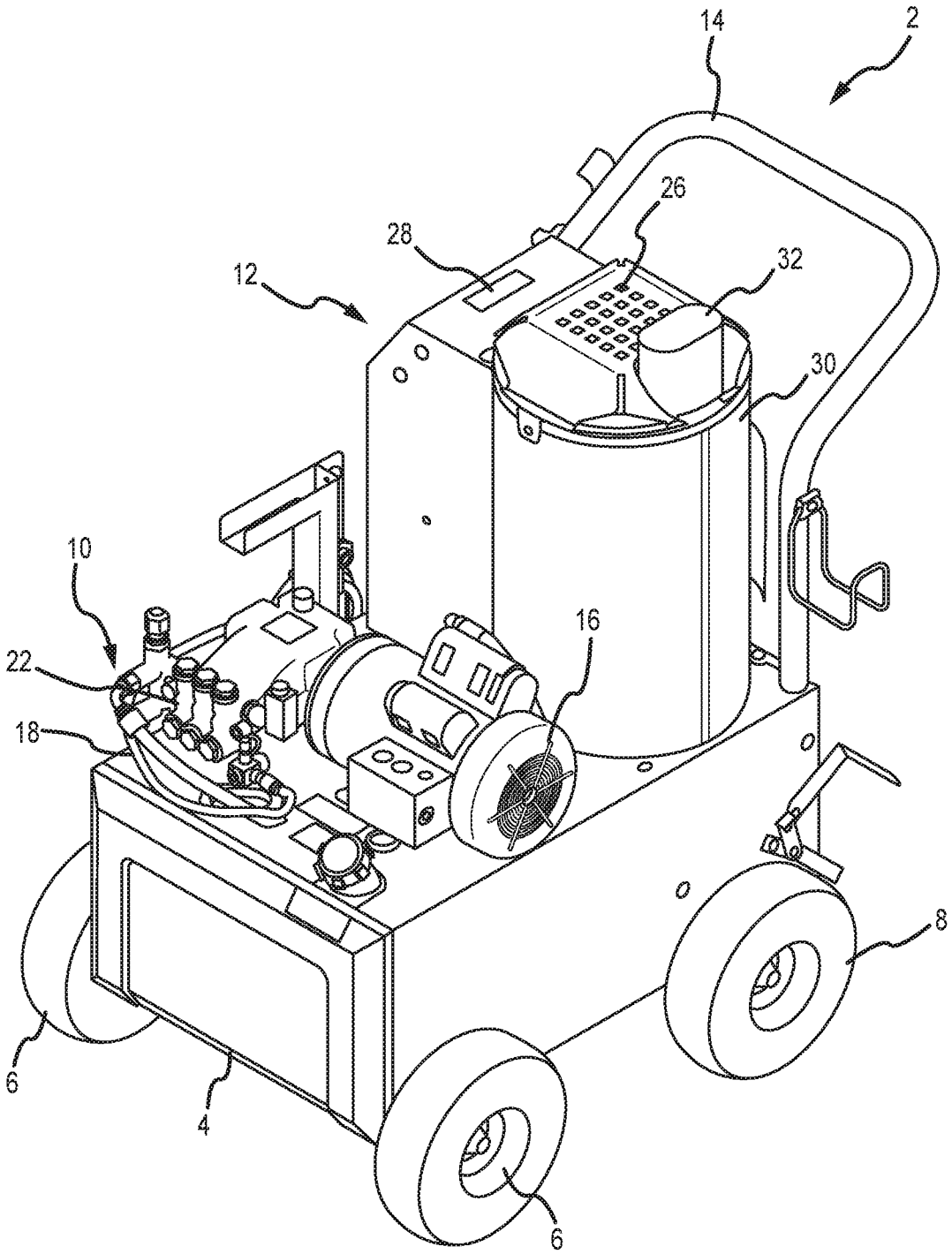
FIG. 2 is a perspective view of a pressure washing device according to the embodiment of FIG. 1.

As shown in FIGS. 1-2, a pressure washing device 2 for producing heated and pressurized water is shown. The device 2 comprises a chassis 4 having front wheels 6, rear wheels 8, a mechanical pressure washer 10, and a heating element 12. The device 2 of FIGS. 1-2 comprises a portable device and is provided with a user-interface or handle 14. The pressure washer 10 comprises known components including, for example, an electric motor 16, a hose 18, and a pump 22. The heating element 12 comprises a housing 30 for a coil and a gas-fired burner for combusting a fuel and transferring heat to a working fluid that is passed through the coil and ultimately dispensed. Burners and gas-fired burners of the present disclosure include but are not limited to devices for combusting one or more fuel materials to transfer energy from the fuel to a working fluid in the form of heat. Burners, gas-fired burners and fuels for use therein include but are not limited to diesel, gasoline, kerosene, natural gas (LNG), liquefied petroleum gas (LPG), propane, and other fuel materials known to be useful in a combustion process and for transferring thermal energy. A control unit 28 is provided. The control unit is contemplated as comprising at least one of a user-interface, a gauge, and control switches or buttons. The heating element 12 comprises an exhaust 32 through which exhaust gas and heat from a burner (for example) is vented to an external environment. Although certain embodiments of the present disclosure are shown in combination with a wheeled device (FIG. 1, for example), inventions of the present disclosure are not limited to use with a wheeled device. Ventilation and cooling features of the present disclosure are contemplated as being used with non-wheeled devices including, for example, pressure washing devices provided on skids or various other devices.

As shown in FIGS. 1-2, a cover member 26 is provided. The cover member 26 comprises a closure or partial closure for an upper portion of the housing 30. The cover member 26 is operable to ventilate the heating element 12, prevent unwanted ingress of various items, and is operable to regulate a temperature of the internal components of the heating element 12 such as an electronic igniter, for example.

As shown in FIG. 2, an exhaust stack 32 is provided. The exhaust stack 32 extends from the housing 30 and through the cover member 26. In various embodiments, the cover member 26 comprises an aperture or void in an angled sidewall of the cover member 26 through the exhaust stack 32 preferably extends.

Figure 3:
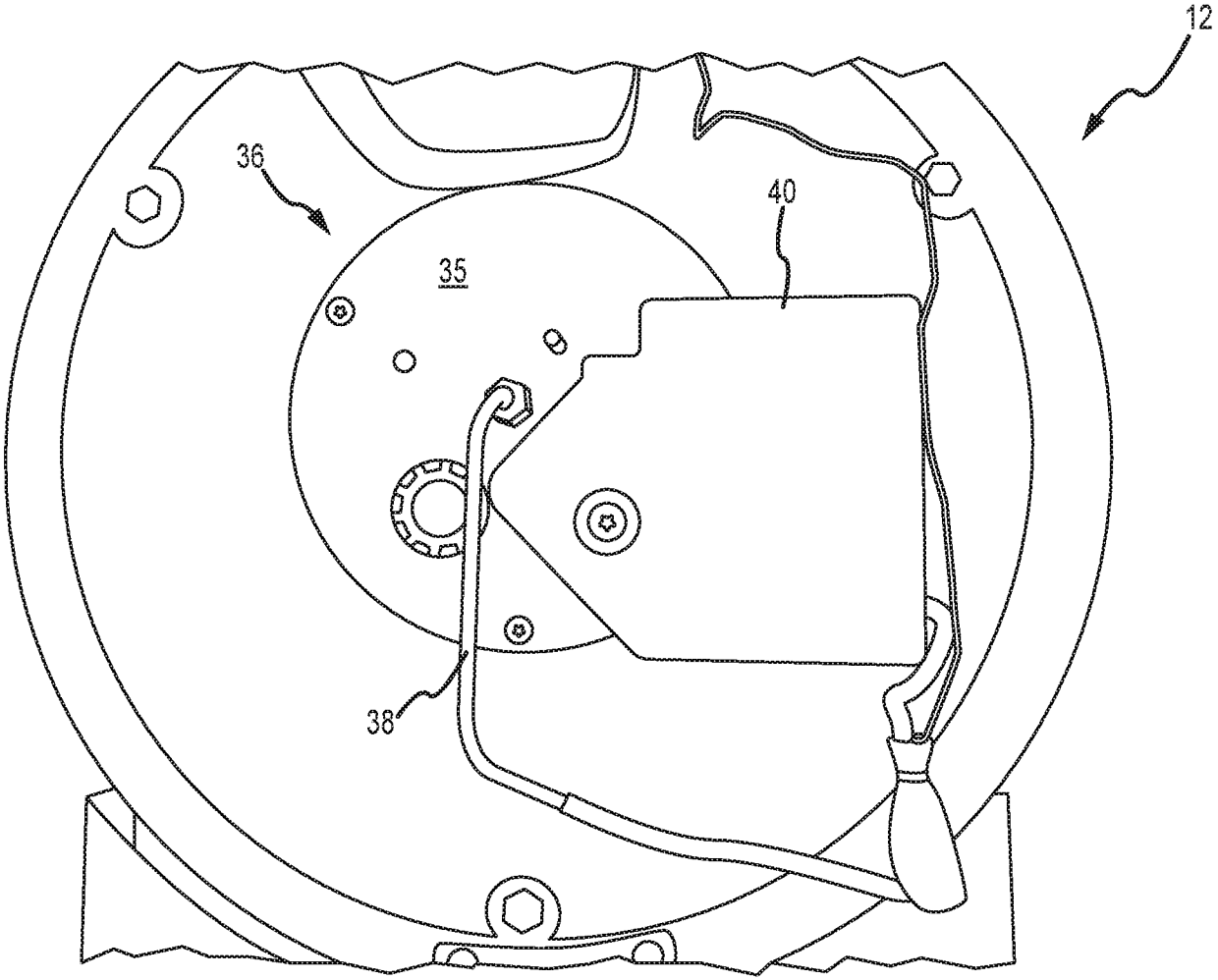
FIG. 3 is a top view of components of a pressure washing device according to one embodiment of the present disclosure.

FIG. 3 is a top plan view of a heating element 12 for use with embodiments of the present disclosure. According to various embodiments of the present disclosure, the heating system 12 includes an enclosed burner element 36. In various embodiments of the present disclosure, the burner element 36 includes a cover plate 35, a gas line 38, and an igniter 40. FIG. 3 illustrates various components that are sensitive to impact, heat and other stresses. It is therefore desirable to protect these components (for example), while simultaneously allowing for ventilation of heat and gas from the device and an area immediately surrounding the cover plate 35 including, but not limited to an area including an igniter, fuel line(s) and electronic components. For example, it is desirable and necessary to maintain the igniter 40 and associated electronics at an appropriate temperature to avoid damage of components.

Figure 4:
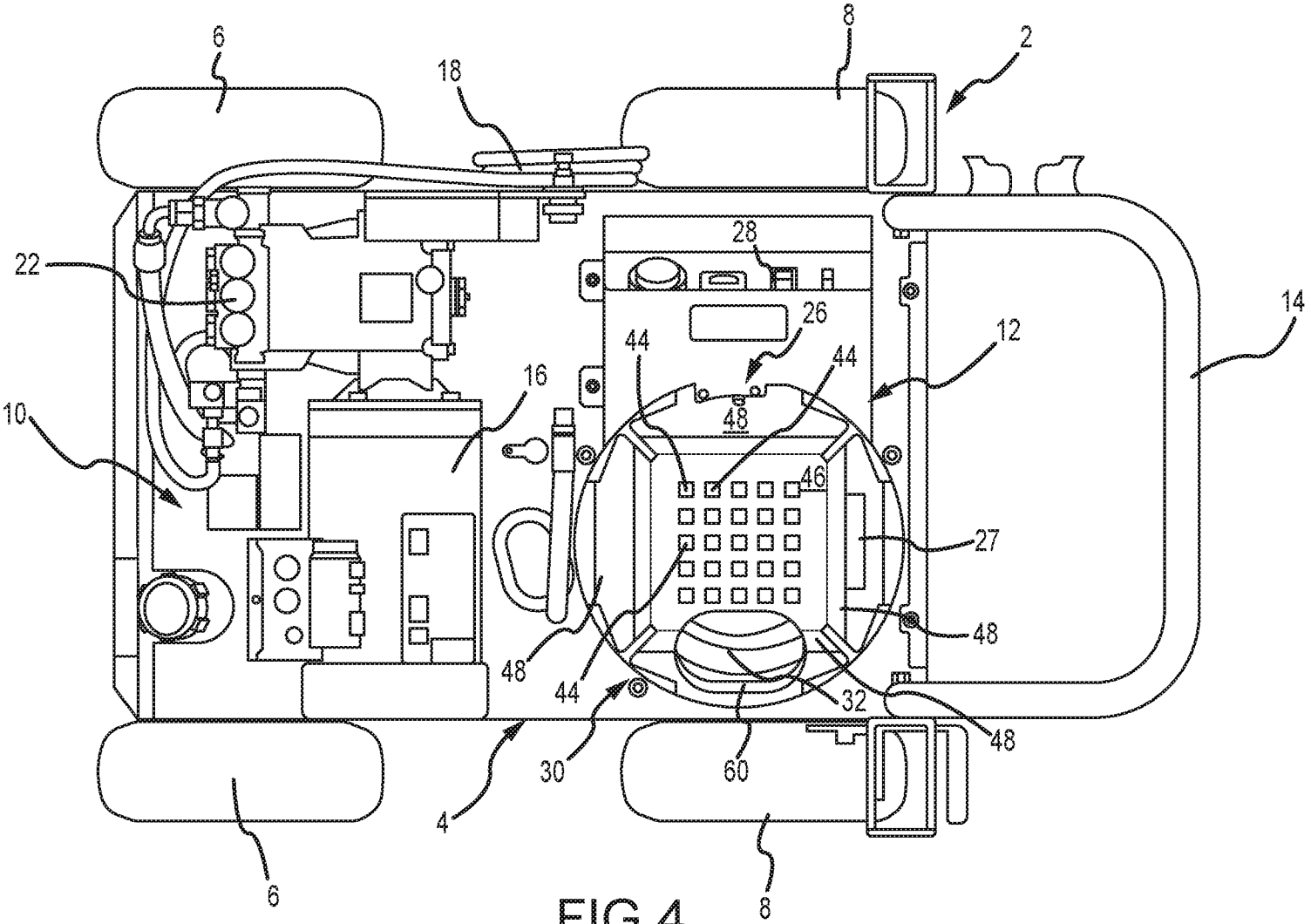
FIG. 4 is a top view of a pressure washing device according to the embodiment of FIG. 1.

FIG. 4 is a top view of the pressure washing device 2 according to the embodiment of FIG. 1. Various components of FIG. 4 have been shown and described with respect to FIGS. 1-3, and that discussion is incorporated by reference. As shown in FIG. 4, a cover member 26 is provided on an upper portion of the housing 30 of a heating element 12 of a pressure washer 2. The cover member 26 comprises a substantially planar upper portion 46 with a plurality of apertures 44. The apertures 44 are provided in an array. For example, in the depicted embodiment, the apertures are provided in a 5×5 grid of twenty-five apertures. It will be recognized, however, that the number, size, overall shape, and spacing the apertures 44 can be varied based on user preference and the device and application in which the cover member 26 is to be used. The device 2 and heating element 12 comprise an exhaust member 32, and the cover member 26 comprises an exhaust aperture 60 for receiving the exhaust member 32 and allowing the exhaust member to extend through the cover member. The exhaust member 32 allows for heat and gas to escape from an internal portion of the heating element 12, while the apertures 44 allow for ventilation and heat dissipation from an upper portion of the heating element (see FIG. 3, for example). At least a portion of the cover member 26 extends over a cover plate of the heating element 12 and associated components including, for example, fuel lines, electronic control members, and related components. The cover member 26 is thus operable to protect sensitive components of the heating element, while also enabling heat dissipation from an upper portion of the heating element and associated components. The cover member 26 is further operable to protect components of a heating element from contact with and damage from various objects. For example, it is contemplated that the device 2 of FIG. 4 is used in various pressure washing applications wherein a user is manipulating a spray gun and associated hose in a variety of unpredictable ways. During such operations, the hose or other features may impact various components of the device 2, including the upper portion of the heating element 12. In such instances, the cover member 26 of the present disclosure provides a protective barrier that prevents the hose (for example) from breaking a fuel line, damaging an igniter, or severing wiring associated with the upper portion of the heating element 12, while also allowing heat to dissipate from the components.

The cover member 26 of various embodiments of the present disclosure comprises a plurality of angled sidewalls 48. The sidewalls, which are shown and described in more detail in FIGS. 6 and 7, extend downwardly from the upper portion 46. At least some of the sidewalls comprise fastening features at lower or bottom portions of the sidewalls to selectively and securely attach the cover member 26 to the heating element 12. The cover member 26 of FIG. 4 further comprises a view port 27 in at least one of the sidewalls 48 of the cover member 26. The view port 27 comprises an elongate aperture that is operable to provide visibility into the cover member and, in some embodiments, allow a user to access components of the heating element 12 (e.g. a shut-off switch for the igniter or electronic control unit). In some embodiments, the view port 27 is provided with a clear or transparent cover (e.g. tempered glass) to allow a user to view the internal components while preventing access to the components.

The cover member 26 of various embodiments protects users from accidentally touching dangerously hot components of the device 2, while also preventing debris from falling into the heating element 12. Furthermore, the cover member 26 prevents the heating system from damage by, for example, a hose 18 being dragged across the heating system 12. The cover member 26 also allows for better heat regulation, by dissipating heat as needed from the heating system 12, and allows for ventilation of heat and gas from a burner by accommodating an exhaust vent of a heating element.

Figure 6:
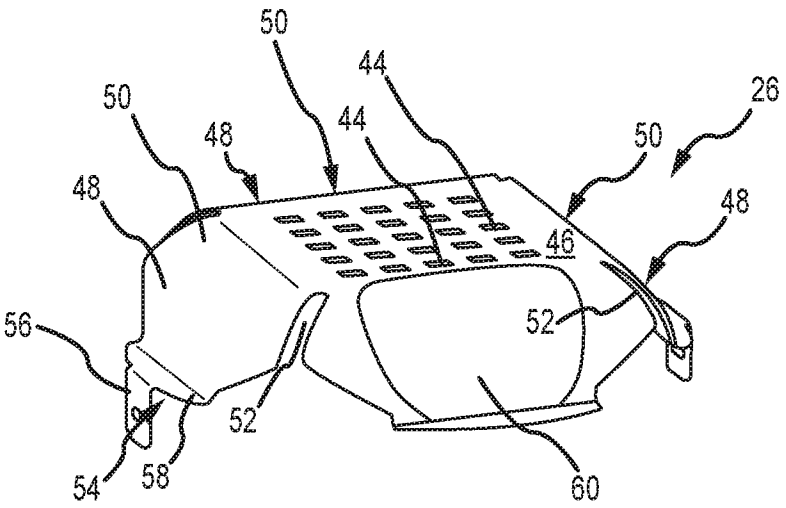
FIG. 6 is a perspective view of the cover member according to the embodiment of FIG. 5.
Figure 5:
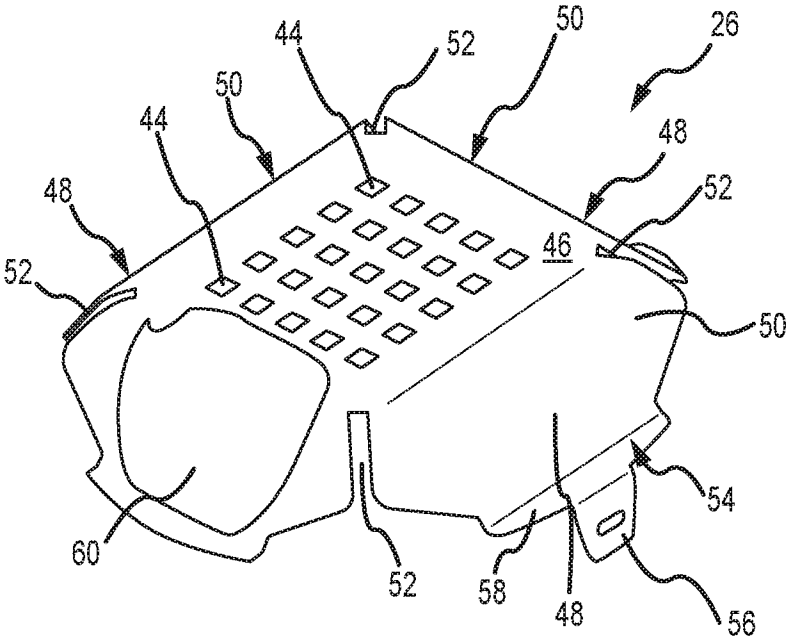
FIG. 5 is a perspective view of a cover member according to one embodiment of the present disclosure.

FIGS. 5-6 are perspective views of a cover member 26 according to one embodiment of the present disclosure. As shown, the cover member 26 comprises a member of unitary construction. In various embodiments, it is contemplated that the cover member is formed from a single sheet or piece of material. In some embodiments, the cover member 26 comprises a steel that is cut and bent to form the cover member shown in FIGS. 5-6. It is also contemplated that cover members of the present disclosure comprise aluminum or other metals. It is further contemplated that cover members of the present disclosure comprise a plurality of different materials. For example, it is contemplated that cover members are provided that comprise various combinations of metal(s) and plastic(s).

FIGS. 5-6 depict a cover member 26 that comprises a plurality of apertures 44 in an upper portion 46 of the cover member. The upper portion 46 preferably comprises a substantially planar portion that is operable to extend over at least a portion of a heating element (for example). A plurality of angled sidewalls 48 are provided that extend from the upper portion 46. In the depicted embodiment, a transition between the upper portion 46 and the sidewalls comprises a bend 50 in the cover member. The sidewalls 48 are preferably formed and separated by voids or cuts 52 in the material to allow for bending and, in some embodiments, to provide additional airflow and ventilation. At least some of the sidewalls 48 terminate at a lower end that comprises securing means to attach the cover member to a device (e.g. a heating element of a hot water pressure washer). As shown in FIGS. 5-6, a concave bend 54 is provided that extends into a flange 58, and the flange 58 comprises a tab 56 with an aperture for receiving a fastener to secure the cover member 26 to an additional component.

The embodiment of FIGS. 5-6 further comprises an exhaust aperture 60 to receive and accommodate an exhaust member 32. The aperture 60 allows a chimney or exhaust vent to extend through and above at least a portion of the cover member 26. The cover member 26 thus allows for ventilation of at least one of heat and gas from a first volume and a second volume, wherein the first volume comprises a space between the apertures 44 and an upper portion of a heating element, and the second volume comprises an internal volume of a heating element (e.g. a burner and coil). Additionally, components and devices provided in at least the first volume are protected from damage by the cover member 26.

The cover member 26 of FIGS. 5-6 comprises a generally convex configuration relative to the heating element 12 and the shroud or housing 30. Although one configuration of a cover member 26 is provided in FIGS. 5-6, alternative embodiments are contemplated that comprise other configurations including, for example, frustoconical members, domed members, and rectilinear members. The device of at least FIGS. 5-6 is devoid of sharp corners that may catch, snag or damage hoses (for example). It is further contemplated, however, that cover members are provided wherein the sidewalls 48 extend substantially perpendicular to the upper portion 46. Therefore, no limitation is provided herein with respect to the size, shape or proportions of cover members.

Figure 7:
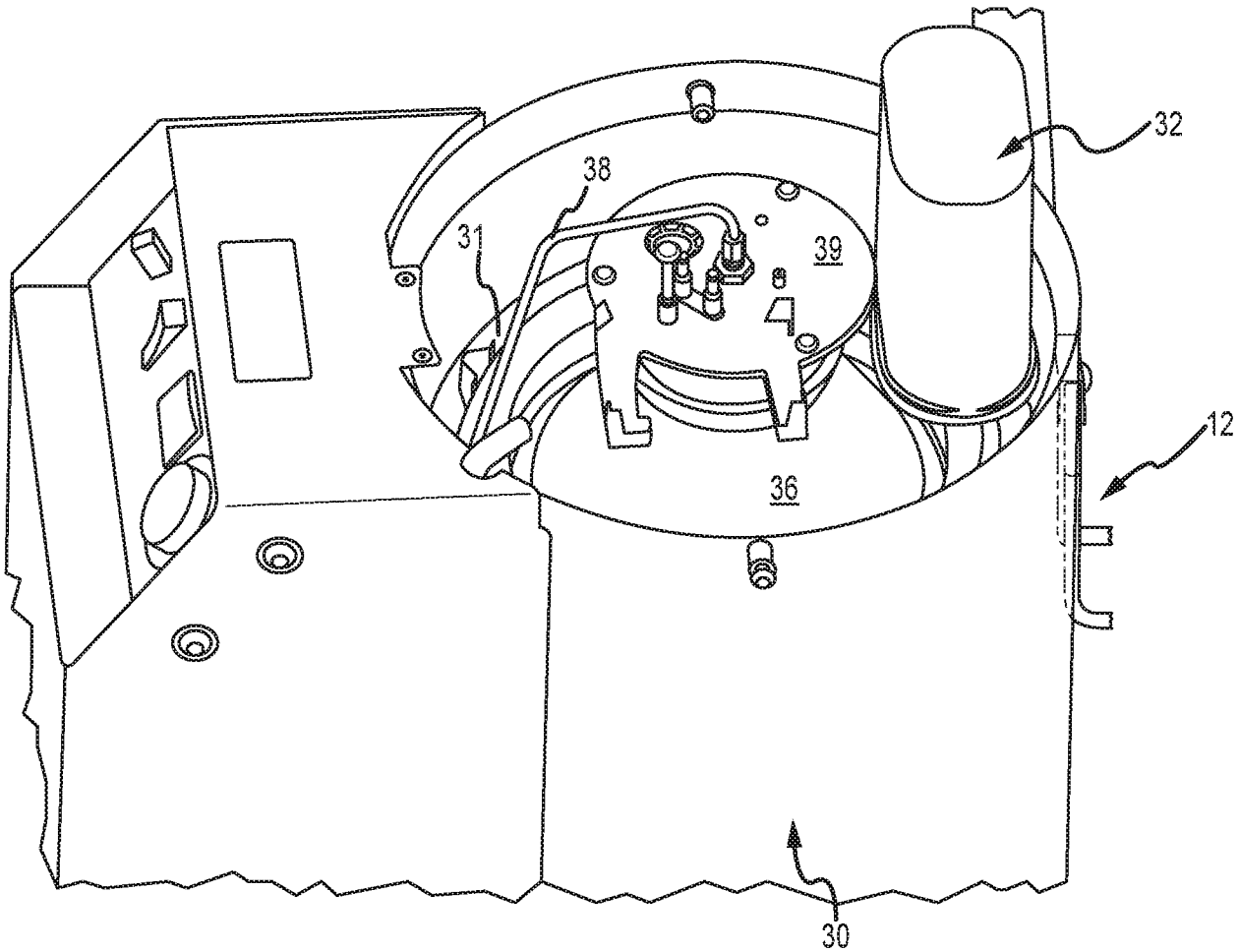
FIG. 7 is a cut-away perspective view of a heating mechanism for a pressure washing device according to one embodiment of the present disclosure.
Figure 8:
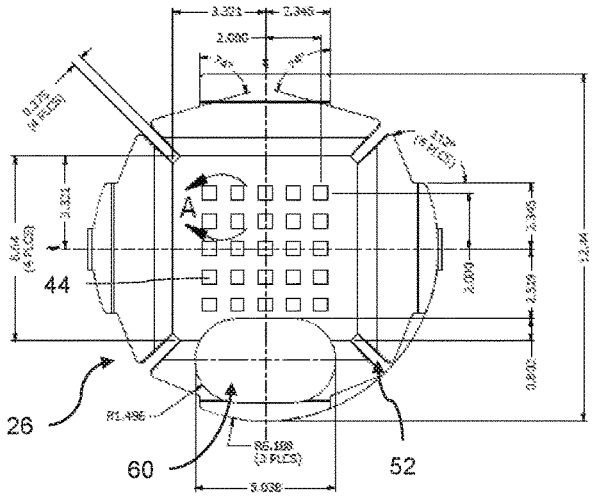
FIG. 8 is a dimensioned top plan view of a cover member according to one embodiment of the present disclosure.

FIG. 7 is a perspective view of a portion of a hot water pressure washer suitable for use with embodiments of the present disclosure. As shown, a heating element 12 is provided that comprises a housing 30, a coil 31, and a burner element 36. Fuel is provided to the burner element 36 by at least one gas line 38. The fuel is combusted and heats a working fluid passing through the coil 31. An upper portion of the burner element 36 comprises a control board 39. Typically, a cover plate (35 in FIG. 3) is provided over at least a portion of the burner element 36. The cover plate is removed for illustrative purposes in FIG. 7. The control board 39, which is provided above the cover plate is operable to support an igniter and an electronic control unit, for example. The cover plate at least partially defines a first volume and a second volume. The first volume comprises a volume above the cover, in which the control board 39 and associated components are positioned. The second volume comprises a volume beneath or external to the cover plate, in which the burner element and coil are provided. An exhaust member 32 extends from the second volume. In various embodiments, and as shown and described herein, cover members of the present disclosure provide heat management and impact protection to both the first and second volumes of heating elements 12 as shown in FIG. 7. The heating element 12 of FIG. 7 comprises a heating element for producing hot water that is typically associated with a pressure washer. However, as shown and described herein, and as will be recognized by one of ordinary skill in the art, cover members of the present disclosure comprise inventive aspects that are not limited to any particular intended use and the present disclosure is therefore not limited to pressure washers, coil-based heat exchangers, or any particular device.

Figure 9:
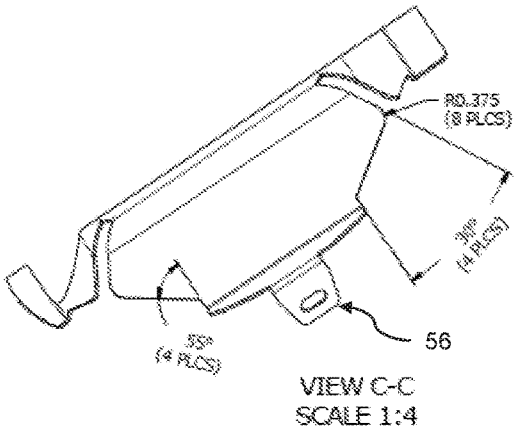
FIG. 9 is a dimensioned elevation view of a cover member according to one embodiment of the present disclosure.
Figure 10:
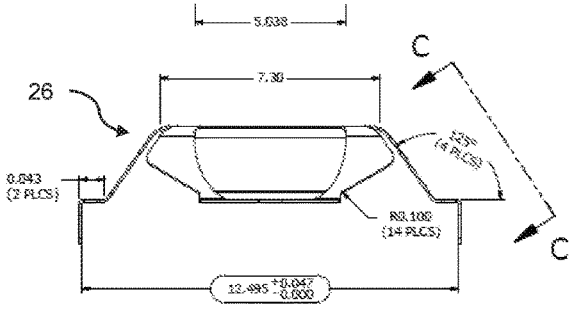
FIG. 10 is a dimensioned elevation view of a cover member according to one embodiment of the present disclosure.
Figure 11:
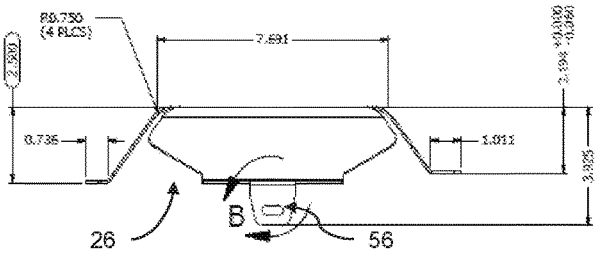
FIG. 11 is a dimensioned elevation view of a cover member according to one embodiment of the present disclosure.
Figure 12:
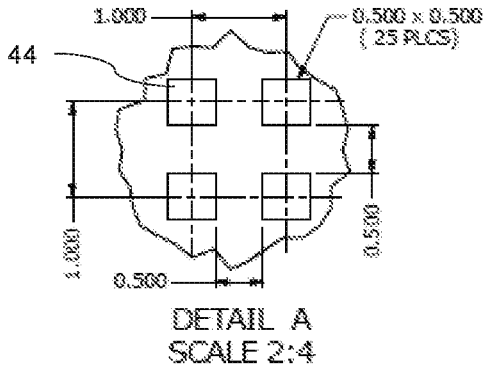
FIG. 12 is a detailed plan view of a portion of a cover member according to one embodiment of the present disclosure.
Figure 13:
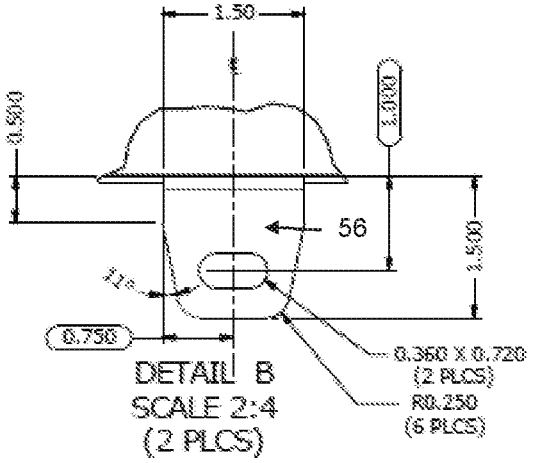
FIG. 13 is a detailed elevation view of a portion of a cover member according to one embodiment of the present disclosure.

FIGS. 8-13 provide various views of a cover member 26 according to one embodiment of the present disclosure. FIGS. 8-13 include dimensions to provide a detailed illustration of one particular embodiment of a cover member 26 in accordance with the present disclosure. It will be recognized, however, that cover members 26 of the present disclosure are not limited to the dimensions or proportions shown in FIGS. 8-13. Various alternatives are contemplated, and the scope and spirit of the inventions provided herein are not limited to the specific dimensions shown in FIGS. 8-13. FIG. 9 is a view taken at view C-C of FIG. 10. FIG. 12 is a detailed elevation view of apertures 44 taken at Detail A referenced in FIG. 8. FIG. 13 is a detailed elevation view of a tab 56 taken at Detail B referenced in FIG. 11. The dimensions are provided in inches.

Figure 15:
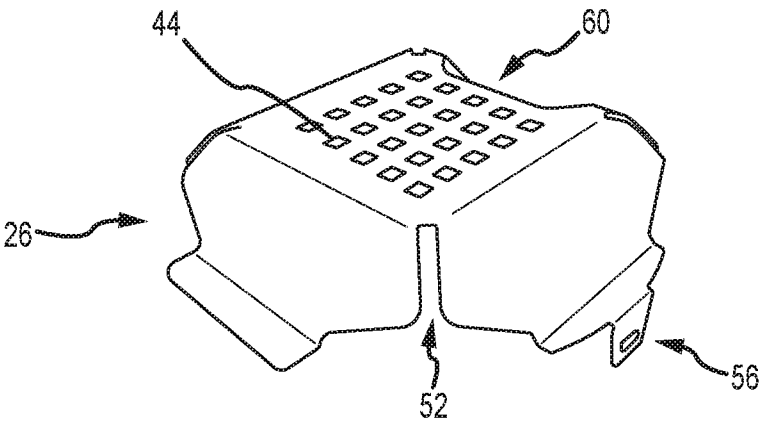
FIG. 15 is a perspective view of a cover member according to one embodiment of the present disclosure.
Figure 14:
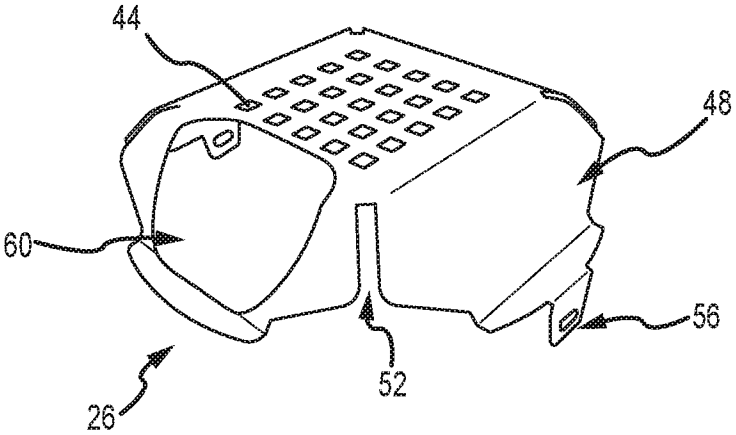
FIG. 14 is a perspective view of a cover member according to one embodiment of the present disclosure.

FIGS. 14-15 are perspective views of a cover member 26 according to one embodiment of the present disclosure. As shown, the cover member 26 comprises different proportions relative to the embodiment shown in FIG. 6 (for example). Various features shown and described in FIGS. 1-7 are provided in FIGS. 8-15. As shown in FIG. 14-15, an overall height of the cover member 26 is greater than the embodiment shown in FIG. 6. The purpose and function of the device, however, is substantially the same as that shown and described in other embodiments.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity so as to not confuse the reader, and it is not intended that such claim term by limited, by implication or otherwise, to that single meaning.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention.

What is claimed is:

1. A heat exchanger for use with hot water pressure washers, the heat exchanger comprising:

a heating element comprising a gas-fired burner, a coil provided proximal to the gas-fired burner, and a housing at least partially surrounding the coil;

an electronic igniter operable to ignite the burner;

a vented cover member comprising:

a planar portion with a plurality of apertures, the planar portion being operable to prevent impact and contact with at least the igniter, and the plurality of apertures being operable to dissipate heat from the heating element;

a plurality of sidewalls, wherein each of the plurality of sidewalls extend at an angle relative to the planar portion, and wherein the angle is an oblique angle.

2. The heat exchanger of claim 1, further comprising an exhaust member that directs an exhaust gas away from the burner and into an ambient environment.

3. The heat exchanger of claim 2, wherein the vented cover member comprises an exhaust aperture, and the exhaust member extends through the exhaust aperture.

4. The heat exchanger of claim 3, wherein each of the plurality of apertures of the planar portion are smaller than the exhaust aperture.

5. The heat exchanger of claim 1, wherein an upper portion of the heating element comprises a control board and a first volume is defined by the control board and the vented cover member, and wherein an igniter is provided within the first volume.

6. The heat exchanger of claim 1, wherein each of the plurality of apertures of the planar portion comprise an open area of not more than approximately four-square inches.

7. The heat exchanger of claim 1, wherein the vented cover member is formed from a single sheet of material.

8. The heat exchanger of claim 1, wherein at least two adjacent sidewalls are separated by a void.

9. A heat exchanger operable for use with a hot water pressure washer, the heat exchanger comprising:

a heating element comprising a coil, a burner for heating a working fluid that passes through the coil, and a housing at least partially surrounding the burner and the coil;

a vented cover member provided on one end of the housing, the vented cover member operable to protect components of the heating element and allow for the exhaust of at least one of heat and gas;

an electronic igniter operable to ignite the burner;

the vented cover member comprising a planar portion with a plurality of apertures, and a plurality of sidewalls extending at an angle relative to the planar portion; and wherein the electronic igniter is positioned vertically above the burner and the coil and below the plurality of apertures, wherein the planar portion and the plurality of sidewalls provide a substantially enclosed internal volume when the vented cover member is secured to the heating element.

10. The heat exchanger of claim 9, wherein at least one of the plurality of sidewalls comprises an exhaust aperture, and wherein the exhaust aperture is operable to vent at least one of heat and gas from the burner.

11. The heat exchanger of claim 10, wherein the heat exchanger comprises a first internal volume and a second internal volume, the first internal volume being at least partially defined by the vented cover member and an upper portion of the housing, and the second internal volume is provided within the housing; and wherein igniter is provided within the first internal volume and the vented cover member is operable to exhaust at least one of heat and gas from the first internal volume; and wherein the burner is provided within the second internal volume and the exhaust aperture is operable to vent at least one of heat and gas from the second volume.

12. The heat exchanger of claim 9, wherein the vented cover member comprises at least one of steel and aluminum.

13. The heat exchanger of claim 9, wherein the vented cover member is formed from a single sheet of material.

14. The heat exchanger of claim 9, wherein at least one of the plurality of sidewalls is provided at an angle of at least 30 degrees relative to the planar member.

15. A heat exchanger for heating a fluid, the heat exchanger comprising:

a heating element comprising a burner, a fluid conduit, and a housing;

an electronic igniter operable to ignite the burner;

a cover plate provided over at least a portion of the burner;

a vented cover member operable to protect components of the heating element and allow for the exhaust of at least one of heat and gas;

the vented cover member comprising a convex member that provides a substantially enclosed internal volume when the vented cover member is secured to the heating element;

wherein the vented cover member comprises a plurality of apertures operable to allow for exhaust of at least one of heat and gas from the substantially enclosed internal volume;

wherein a first volume is provided below the cover plate and a second volume is provided above the cover plate and below the vented cover member; and wherein at least one of the electronic igniter and an electronic control unit are provided in the second volume.

16. The heat exchanger of claim 15, wherein the housing comprises a substantially cylindrical housing, and wherein the vented cover member comprises a covering for the housing.

17. The heat exchanger of claim 15, wherein the vented cover member comprises a first planar portion and a plurality of planar sidewalls extending from the first planar portion.

18. The heat exchanger of claim 15, further comprising an exhaust stack that directs an exhaust gas away from the burner and into an ambient environment.

19. The heat exchanger of claim 18, wherein the exhaust stack extends through the vented cover member.

20. The heat exchanger of claim 15, wherein the vented cover member is formed from a single sheet of material.

* * * * *